US012269630B2

(12) United States Patent
Biondi et al.

(10) Patent No.: US 12,269,630 B2
(45) Date of Patent: Apr. 8, 2025

(54) PRODUCTION DEVICE AND PRODUCTION PROCESS FOR INFUSION TYPE CAPSULES

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT)

(73) Assignee: G.D S.P.A., Bologna (IT)

( * ) Notice: Subject to any disclaimer, the term of this patent is extended or adjusted under 35 U.S.C. 154(b) by 23 days.

(21) Appl. No.: 18/006,386

(22) PCT Filed: Jul. 26, 2021

(86) PCT No.: PCT/IB2021/056720
§ 371 (c)(1),
(2) Date: Jan. 22, 2023

(87) PCT Pub. No.: WO2022/029548
PCT Pub. Date: Feb. 10, 2022

(65) Prior Publication Data

US 2023/0312150 A1 Oct. 5, 2023

(30) Foreign Application Priority Data

Aug. 5, 2020 (IT) ..... 102020000019321

(51) Int. Cl.
*B65B 29/02* (2006.01)
*B65B 43/50* (2006.01)

(52) U.S. Cl.
CPC ..... *B65B 29/022* (2017.08); *B65B 43/50* (2013.01)

(58) Field of Classification Search
CPC ... B65B 29/022; B65B 43/50; B32B 2250/03; B32B 2250/20; B32B 2262/0276; B32B 2307/718; B32B 2307/732
(Continued)

(56) References Cited

U.S. PATENT DOCUMENTS 6,440,256 B1 8/2002 Gordon et al.
2009/0211713 A1* 8/2009 Binacchi ..... B29C 66/1122 156/423

(Continued)

FOREIGN PATENT DOCUMENTS

DE 102017204541 A1 9/2018
WO 2020/128782 A1 6/2020

OTHER PUBLICATIONS

International Search Report and Written Opinion for International Application No. PCT/IB2021/056720 filed on Jul. 26, 2021 on behalf of G.D S.P.A. Mail Date: Sep. 17, 2021 10 pages.

*Primary Examiner* — Robert F Long
*Assistant Examiner* — Xavier A Madison
(74) *Attorney, Agent, or Firm* — Steinfl + Bruno LLP

(57) ABSTRACT

A device and a production process for capsules, in particular infusion type products, to continuously deliver filters into the capsules, independently of the flow feed rate of the filters and of the cup-shaped containers of the capsules. The device includes: filter delivery devices; a first transport system the delivery devices, continuously moving them along a first closed path; a second transport system of support devices continuously moveable along a second closed path, each support device configured to receive a respective cup-shaped container. The first closed path includes a filter inserting segment superimposed to the second closed path, so that the
(Continued)

delivery devices and respective support devices are synchronized with each other, to continuously transfer a filter to a target cup-shaped container.

20 Claims, 8 Drawing Sheets

(58) Field of Classification Search
USPC ..... 53/410
See application file for complete search history.

(56) References Cited

U.S. PATENT DOCUMENTS

| | | | | |
|---|---|---|---|---|
| 2017/0096243 | A1* | 4/2017 | Manaresi | B29C 66/8322 |
| 2020/0290797 | A1 | 9/2020 | Steffen | |

* cited by examiner

Fig. 7A
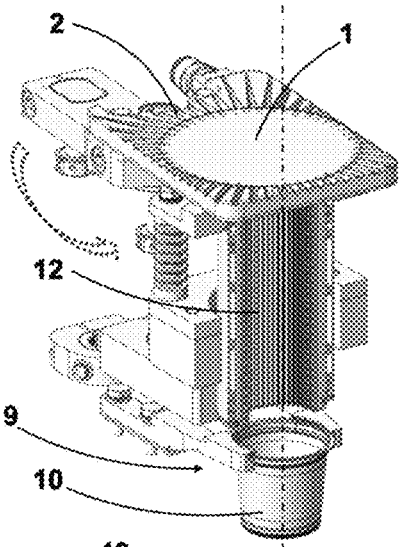
Fig. 7B
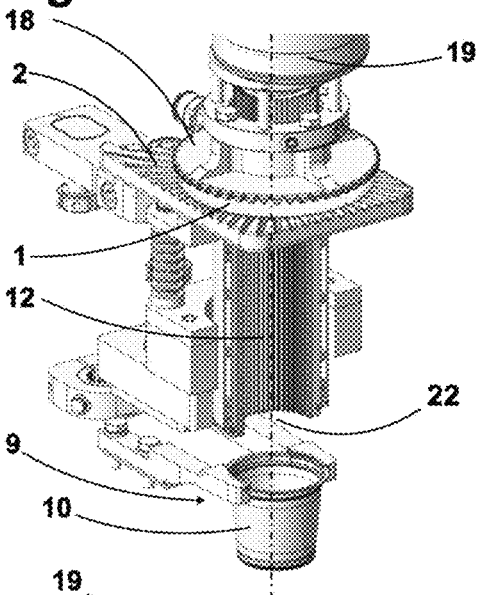
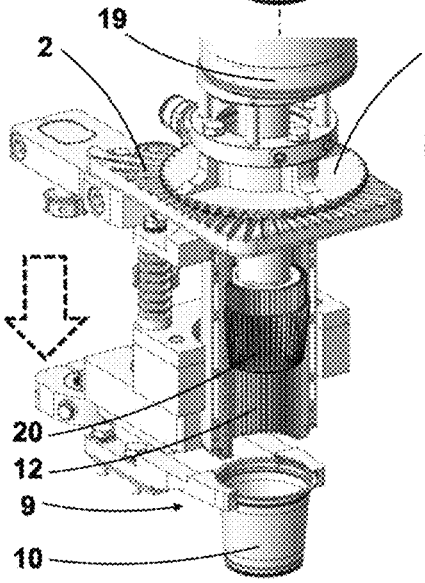
Fig. 7C
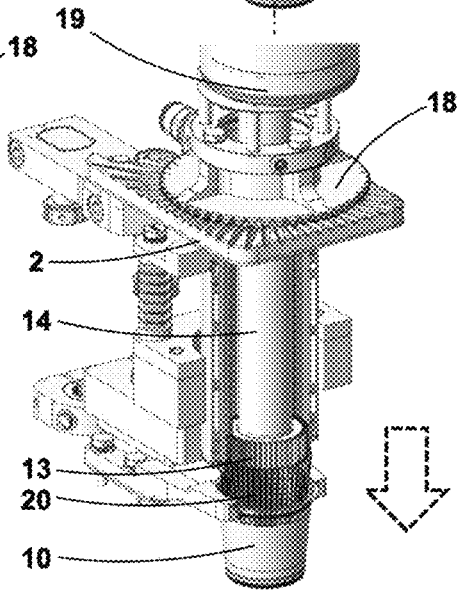
Fig. 7D

PRODUCTION DEVICE AND PRODUCTION PROCESS FOR INFUSION TYPE CAPSULES

CROSS REFERENCE TO RELATED APPLICATIONS

The present application is the US National Stage of International Patent Application No. PCT/IB2021/056720, filed on Jul. 26, 2021, which in turn, claims priority to Italian Application No. IT 102020000019321, filed on Aug. 5, 2020.

DESCRIPTION

The present invention relates to a device and a process for producing infusion type capsules in an apparatus and a packaging process.

The present invention finds a preferred, though not exclusive, application in the field of packaging of infusion type capsules for infusion products, in particular beverages which are obtained by an infusion process and with the addition of an edible liquid such as water or milk, to obtain an infusion, for example coffee, a field to which reference may be made hereafter without loss in generality.

In particular, in the relevant technical field, production devices are known to couple together a cup-shaped element and a filter, which may be specially delivered or may be obtained at the same time by a shaping process.

Therefore, the need to dispense filters, or possibly to form and insert them individually from a quantity of discrete elements, implies the need to couple the filters with their respective cup-shaped elements when both the latter and the filters, or discrete elements, are fed into the packaging apparatus with high flow rates that must be synchronised.

In this description and in the accompanying claims as well, certain terms and expressions are deemed to have, unless otherwise expressly indicated, the meaning expressed in the following definitions.

Here and in the following, a discrete element is defined as an element formed from a single piece that must be processed individually at high speed, with the final aim of coupling it to a corresponding discrete target element.

In particular, it is envisaged that these discrete elements, downstream of any machining or extraction process or even pre-forming, are fed onto lines of discrete elements, through which a predetermined spacing between the discrete elements is achieved, allowing the intervention of tools, none of them interfering with discrete elements not being of their competence.

By way of example, a discrete element may consist of a component that is intended to be coupled with a cup-shaped element that is supplied to the packaging process in this form.

This discrete element therefore constitutes the semi-finished product for obtaining a filter, which must then be coupled to a cup-shaped element to form a brewing capsule, ready to be filled with the brewing product for the product to be obtained, e.g. coffee powder or instant coffee.

In the case of the filter, the discrete element may be a laminar element, e.g. shaped like a disc, made of a paper material to make infusion filters, then allowing the filtered passage of a water-based infused liquid, without allowing an infusion material such as ground coffee or shredded tea leaves to pass through.

Once fed, these discrete elements must each be placed on a respective receiving element, and the necessary shaping and application operations to the destination cup-shaped container must be carried out rapidly and in synchrony with the feeding of the cup-shaped elements themselves, which will then be able to receive the filter itself, as soon as the shaping thereof is complete.

It is understood that discrete elements, as well as receiving elements, are continuously transported when they move with a predetermined speed, possibly variable, i.e. subject to accelerations and decelerations, but never nihil. Continuous feeding and transport are therefore different from step feeding and transport, in which the corresponding discrete elements and/or receiving elements move step-by-step.

A "cup-shaped container" means a hollow element of round or cylindrical shape intended to form a capsule with the function of a container, of wrapping, covering, protecting, covering or closing a product contained within it, thus possessing a predetermined shape, in which a head and a bottom are identified, and which is arranged in an upright vertical arrangement with the head facing upwards, which in turn has an opening that may be sealed by a lid.

In turn, the capsules will have a substantially truncated conical or truncated pyramidal shape, or equivalent shapes.

Feeding or transporting "in a line" means that discrete elements are supplied in a sequence of discrete elements aligned to each other, resulting from an extraction or processing.

It is understood that in the line, each discrete element is spaced from the elements preceding and following it with a constant spacing, resulting from the extraction and/or processing step.

A "release device" means a device that provides said discrete elements in the manner mentioned above.

By "feeding segment" it is meant a segment along which said release device transfers discrete elements to a subsequent transport path. In particular, even when discrete elements are continuously fed, their release takes place at a release spot that belongs to the feeding segment, which can therefore be defined as the linear section over which the possible release points of a release device fall.

The term "transport system" or "transport device" means any system designed to transport discrete elements while maintaining their respective singularity, i.e. without them interfering with each other in any way. The same concept also applies to cup-shaped containers.

The "transport path" is understood to be the path taken by receiving elements and support devices designed to individually accommodate a respective discrete element and a respective cup-shaped container.

The term "closed transport path" means a transport path of the receiving elements developing along a closed line on a substantially horizontal plane, while the term "carousel structure" means a transport device that operates on a closed transport path, letting the articles and the respective pincer devices, or in any case the movable devices therein provided, carry out a so called revolution which, for this reason, should not be confused with the alternated roundtrip motion that is typical for a belt conveyor.

"Delivery device" means a device that provides filters that are formed and ready to be inserted into a cup-shaped element. It may comprise a shaping device, which makes filters from a semi-finished product supplied to it, as in the case of the aforesaid discrete elements. Alternatively, it could be fed with filters that require correct positioning with respect to the cup-shaped element to achieve their insertion.

"Shaping device" means an apparatus which, on receiving a discrete element for shaping a filter, permanently deforms it into a flared cup-shaped container shape, which mates with the cavity of the cup-shaped container and can be inserted into it through its upper opening.

It is also understood that the shaping device may be an integral part of the delivery device.

The term "piston" refers to a linearly actuated, reciprocating member which has a drive stem and a movable head in a cylindrical cavity. In the following description, the term "piston" is associated with a shaping punch of aforesaid shaping device, which operates from a piston head in a substantially cylindrical shaping cavity.

The Applicant noted that, in packaging processes, the speed of transfer and insertion of the articles to be packaged into the target packagings is crucial to the overall economics of the process, as high production volumes can be achieved with fewer packaging apparatuses.

Furthermore, the Applicant observed that, in addition to the need to proceed as quickly as possible, another important and unavoidable requirement is the flexibility required of this type of equipment, in particular with regard to the different production formats, which entail the need to be able to operate, with the same apparatus, on different shapes and sizes of filters and discrete elements.

This requirement is particularly acute at high speeds, when precise and correct positioning of the filters in their target positions and of the respective cup-shaped elements is critical to the economy of the production process.

Furthermore, this need is reinforced when, in a packaging machine, an increase in the process speed is required and which must be managed without any inconvenience or error.

Additionally, the apparatus must also be able to handle capsules of different formats, where filters and cup-shaped containers of different sizes must fit together without requiring intervention in the packaging apparatus.

The Applicant also verified that the continuous feeding of both filters, and in particular discrete elements for a contextual shaping process, as well as of cup-shaped containers enables the productivity rates required for this type of apparatus to be achieved in a packaging apparatus, leading to a reduction in feeding and passage times.

The Applicant found that, in general, synchronisation between the flows of filters or discrete elements and cup-shaped containers represents a promising starting point for the realisation of a device and process for inserting filters in the production of infusion type capsules.

The Applicant also realised that this requirement is manifested in both continuous and step feeding, and especially in feeding at high speeds this problem requires the adoption of appropriate measures to achieve the required flexibility.

The Applicant therefore perceived that the adoption, both for the flow of discrete elements and for the flow of cup-shaped containers, of respective closed shaping and insertion paths can allow the optimisation of the use of a given number of shaping and insertion devices, while at the same time allowing the efficient management of the process speed.

The Applicant finally found that by synchronising the paths of filter shaping and transport of the filter elements at least at the filter insertion stage, i.e. its passage into the container, it is possible to optimise this step, allowing all the flexibility required.

In particular, in a first aspect thereof, the invention relates to a production device for infusion type capsules, i.e. for delivery filters within respective cup-shaped containers.

Preferably, the production device comprises a plurality of filter delivery devices.

Preferably, the production device comprises a first transport system for the delivery devices, which moves them continuously along a first closed path.

Preferably, the production device comprises a second transport system of support devices which are continuously moved along a second closed path.

Preferably, each support device receives a respective cup-shaped container.

Preferably, said first closed path comprises a filter inserting segment, which is superimposed to said second closed path thereby the delivery devices and the respective support devices of the cup-shaped containers are synchronized to each other, to continuously achieve the transfer of the filter to a target cup-shaped container.

Thanks to these features, it is possible to create a device for producing infusion type capsules in which the two streams of filters and cup-shaped containers allow the filters to be inserted continuously, thus shaping an infusion type capsule, independently of both the feed rate of these streams and the format of the filters and cup-shaped containers.

Moreover, thanks to these features, the same insertion moving members are continuously reused, i.e. the same delivery and support devices, which are mobile on closed paths but synchronised in the insertion step.

This allows them to vary their speed of circulation, without causing any inconvenience in the production process.

In a second aspect thereof, the invention relates to a production process for infusion type capsules, in which filters are delivered into respective cup-shaped containers.

Preferably, in the production process for infusion type capsules a plurality of delivery devices move along a first closed path.

Furthermore, in the production process for infusion type capsules a corresponding plurality of transport devices, each retaining a respective cup-shaped container, move along a second closed path.

Preferably, the aforesaid production process comprises an insertion step in which said first and second closed paths are superimposed at an insertion segment.

Preferably, in said insertion segment the filters are placed in their respective cup-shaped containers.

In other words, this superposition allows the synchronisation of filter delivery and the transport, in a single line, of cup-shaped containers, into which the respective filters can then be inserted seamlessly.

In addition, the process is insensitive to the size of the filters and the starting cup-shaped containers, which can in any case be synchronised and centred on each other for filter formation and insertion, and at any passing speed.

In a third aspect thereof, the present invention relates to a packaging apparatus comprising a device for producing infusion type capsules according to the first aspect of the invention as outlined above.

In other words, this apparatus comprises a device for producing infusion type capsules that can be continuously fed, and that provides a continuous output of capsules, regardless the capsule format and the flow rates of the starting semi-finished products.

In at least one of the aforesaid aspects, the present invention may further comprise at least one of the following preferred features.

Preferably the first and second transport systems are implemented on the same circular carousel.

Moreover, they are entirely superimposed on each other.

Preferably, each shaping device and a respective support device are associated with each other in the same moving member, which is moved by said carousel.

The adoption of this feature allows for considerable structural simplification and a reduction in space, as well as the use of a number of delivery devices and fixed support devices that are used repeatedly.

It should be noted that, thanks to this feature, irrespective of the number of moving members, it is possible to increase the production rate by increasing the speed of the moving members on their closed routes.

To achieve a flow of cup-shaped elements and filters of adequate capacity, the number of delivery and support devices will be at least 16, arranged equally spaced on the respective transport paths.

In this respect, the production device preferably comprises a transport device with a rotary drum on which said first and second transport systems are formed, so as to define said first and second closed paths, thereby achieving even greater structural simplification.

Thanks to this feature, an increase in the transport speed of movable shaping members can be achieved simply by increasing the rotation speed of the rotary drum.

With a predefined rotary drum configuration, its rotation speed can be varied to ensure a flow of filters and cup-shaped elements with a rate of at least 600 pieces per minute, even more preferably at least 1000 pieces per minute.

Preferably, the delivery device comprises a shaping device for shaping filters from discrete elements which are fed into the first closed path at a receiving segment thereof.

In addition, the first closed path comprises a filter shaping segment between the receiving segment of said discrete elements and the filter insertion segment.

This makes it possible to exploit the closed path not only for the insertion of filters but also for their shaping from a semi-finished product that can be subjected to a shaping process while it is being transported.

Preferably, each shaping device is provided with a passing-through cavity with an upper mouth through which a discrete element is released.

In addition, each shaping device is equipped with a punch that is driven through said mouth to push the discrete element into the passing-through cavity.

In this way, the shape of the internal walls of the passing-through cavity and the surface of the punch, and their mutual interference, in turn determines a cup shape of the filter.

In addition, the punch of the shaping devices is retained up at a predetermined distance from the upper mouth of the passing-through cavity at least at said receiving segment of the first closed path.

In addition, the shaping devices being driven, by lowering their respective punches, in said shaping segment.

Thanks to the structure described above, discrete elements can be supplied continuously to the delivery device, and can always be formed continuously in the section between the receiving segment and the insertion segment with a single piston action.

Preferably, the insertion of the filter into the respective cup-shaped container is determined by a piston, associated with said punch, which pushes the filter through said passing-through cavity, so that the filter falls into the cup-shaped container.

This aspect makes it possible to optimise the synchronisation between the shaping step and the insertion step, both of which are performed thanks to the piston's travel to bottom dead centre and return.

Preferably, in the production process, the shaping device comprises passing-through cavity and a punch so that, in said shaping step, the mouth of the receiving element is positioned in such a way as to allow the punch to penetrate through said mouth of the receiving element and said passing-through cavity.

In addition, the shape of the walls inside the passing-through cavity and the surface of the punch, and their mutual interference, result in a cup shape of the filter obtained from said discrete element.

Preferably, the drive of all the shaping devices is determined, by means of special kinematic chains, by the same drive shaft that causes the rotation of the rotary drum, so that this drive is automatically synchronised with the rotation of the carousel itself.

In addition, this type of drive allows only one motor to be used for all drives.

Preferably, each movable shaping member comprises a respective shaping device and a respective support device positioned in axis with each other, facilitating the passage of the filter from one to the other.

Preferably, each moving member comprises a respective receiving element, which is movable with respect to said passing-through cavity, on which said upper mouth is formed, and in which, in said first closed path, the receiving elements each receive a respective discrete element in said receiving segment.

In this way, the feeding of discrete elements is spatially disengaged from the shaping devices, facilitating the possible feeding of discrete elements of different formats, which could be released at different points in the receiving segment.

Preferably, the drive of all the shaping devices is determined, by means of special kinematic chains, by the same drive shaft that causes the rotation of the rotary drum, so that this drive is automatically synchronised with the rotation of the carousel itself.

In addition, this type of drive allows only one motor to be used for all drives.

In this way, thanks to the overlap between the receiving element and the passing-through cavity, the filter is formed with a single stroke of the punch.

Preferably, in the insertion step of the production process, the punch continues its stroke through the passing-through cavity causing the filter to come out of one end and be inserted into the respective cup-shaped container.

In this way, the aforesaid single stroke of the punch also causes the filter to be inserted at its final destination.

Preferably, the transport device comprises a synchronizing mechanism which acts on said receiving elements by moving them with respect to the transport device.

In this way, their position in said receiving segment always corresponds to that of the discrete elements in the feeding segment.

Preferably, the receiving elements are aligned to each other at said receiving segment.

Preferably, the synchronizing mechanism comprises, for each receiving element, a rotatable articulation driven by the transport device, to facilitate its movement and its actuation, which may, for example, by an electric motor adjusting the position of the articulation lever, by an electronic cam, or by a mechanical cam structure associated with the lever itself.

Preferably, each receiving element is plate-shaped with the upper mouth formed at its centre and a horizontal flat surface on which said discrete elements are released, facilitating the deposition of the discrete element.

Preferably, to retain the discrete element in a fixed reference position, the receiving element receiving the discrete element comprises a vacuum shaping suction system between the receiving surface of the receiving element and the discrete element.

This allows the discrete element to be associated with the receiving element at a predefined position.

Preferably, the receiving element receives a movable press element in synchrony with the respective punch, which clamps and crushes said discrete element prior to insertion of the punch.

In this way, contact between the punch and the discrete element cannot cause unwanted displacement of the latter.

Preferably, the receiving surface of the receiving element has a knurling, with ribs that help to initiate the shaping of a surface pleat in the filter.

Preferably, said passing-through cavity has a cylindrical tubular structure having a funnel-shaped entrance end and an outlet end.

Preferably, said entrance end mates with the upper mouth of the receiving element, connecting with it and shaping a single sliding surface for the discrete element, when it is arranged on axis with the tubular structure of the passing-through cavity.

Preferably, said passing-through cavity has a circular wall connected to said end of the inlet, which has internally first vertical ribs extending on said end of the inlet.

In addition, the punch has respective second vertical ribs complementary to said first vertical ribs, fitting into the slot between them.

Their interference then causes a wrinkling of the filter surface, increasing, by the formation of a pleat, the filtering surface area for the same filter size.

Preferably the passing-through cavity, in particular its walls, and/or the punch are equipped with a heating device, for example with one or more thermoresistors, to bring about a stretching effect causing a pleating, i.e. a wrinkling, on the lateral wall of the filter.

Preferably, the support devices are shaped like pincers that grip a respective cup-shaped container laterally, so that it has an upward-facing capsule opening.

The present invention will hereinafter be described according to a preferred embodiment thereof, which is provided for illustrative and non-limiting purposes with reference to the accompanying drawings in which:

FIGS. 7A to 7J show respective perspective views of a shaping device for infusion type capsules, illustrating various stages of the filter shaping process.

Figure 1:
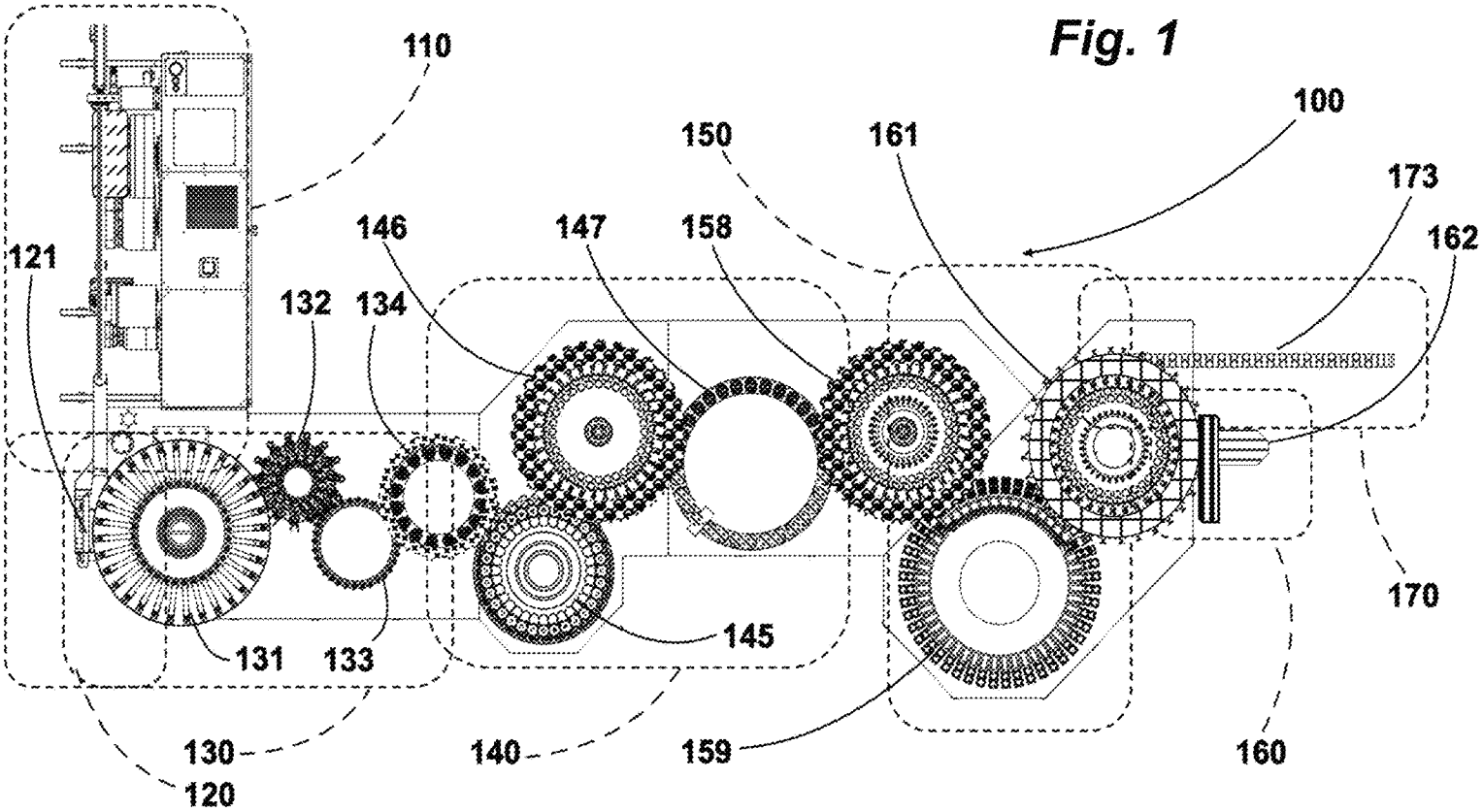
FIG. 1 shows a plan view of an embodiment of a packaging apparatus comprising a discrete element transfer device made according to the present invention.

With reference to the accompanying FIG. 1, a packaging apparatus for capsules for infusion type beverages, such as coffee, is referred by 100, mentioned in the following for short as infusion type capsules.

These infusion type capsules are formed by a substantially rigid cup-shaped container, inside which a filter is arranged. During the subsequent packaging steps, a preparation based on coffee powder is added to the infusion type capsules, and then the capsules are sealed with the application of a lid and sent to a subsequent apparatus where they are boxed for distribution and sale.

In general, the cup-shaped containers, hereafter referred to as 10, are supplied by a feeding station 110, from which they proceed in a line with a continuous motion after being extracted from a set of cup-shaped containers provided by a supplier.

The packaging apparatus 100 comprises a release station 120 of discrete elements, which will be indicated in the following figures by 1, which in the present example comprise flat discs of a material suitable for shaping a filter for infusion products, in particular beverages.

Thus, the release station 120 comprises a release device 121 which in the present example is a device for cutting said discs from a continuous strip of filter material.

The release device 120 thus provides discrete elements 1, in the form of discs, which are fed individually, i.e. one by one after a cutting step, in a single line with a predetermined spacing between one discrete element and a subsequent discrete element.

The packaging apparatus therefore comprises a filter shaping station, designated 130, which includes a carousel-like device for producing infusion type capsules 131, which will be described later in greater detail.

The production device 131 is part of a more complex station, in which said discrete elements 1, once transferred from the release device 121 to the transport device 131, undergo a process for shaping the filter, which is then inserted inside the target cup-shaped container, which may possibly contain on its bottom a spacer element inserted inside it in the feeding station 110.

In this way, filters are delivered directly to the target cup-shaped containers. It is intended that the device for producing infusion type capsules 131 could be fed with filters that are already preformed, at least partially.

At the end of the step of inserting the filter into the respective cup-shaped container, the filter is fixed, for example by welding, to the internal walls of the cup-shaped container, thus shaping the infusion type capsule.

In this connection, the transport device 131 transfers the cup-shaped containers with filters to a first transfer wheel 132, and from this they pass to a filter fixing wheel 133, then to pass to a second transfer wheel 134 which transfers the cup-shaped containers to a filling station 140, where they are filled with a predetermined dose of coffee powder.

In this regard, the filling station comprises a carousel-like filling device 145 from which the cup-shaped containers are transferred, by means of a third transfer wheel 146, to a carousel-like weighing device 147, performing a check on the amount of powder supplied to each container.

Upon leaving the weighing device 147, the containers are transferred by a fourth transfer wheel 158 to a sealing station 150. The apparatus 100 thus comprises a cutting station 160 for lids that are formed from a continuous strip by a cutting device 162.

The lids, which are disc-shaped, are transferred, by means of a fifth transfer wheel 161, to a sealing device 159, also structured as a carousel, which receives the infusion type capsules to be sealed by said fourth wheel 158 and which provides for the extraction of the gases from the capsule and its sealing by applying on its upper opening a disc-shaped lid made from continuous strip.

Once sealed, the capsules are forwarded to an outlet station 170, equipped with a linear transport device 173.

Figure 2:
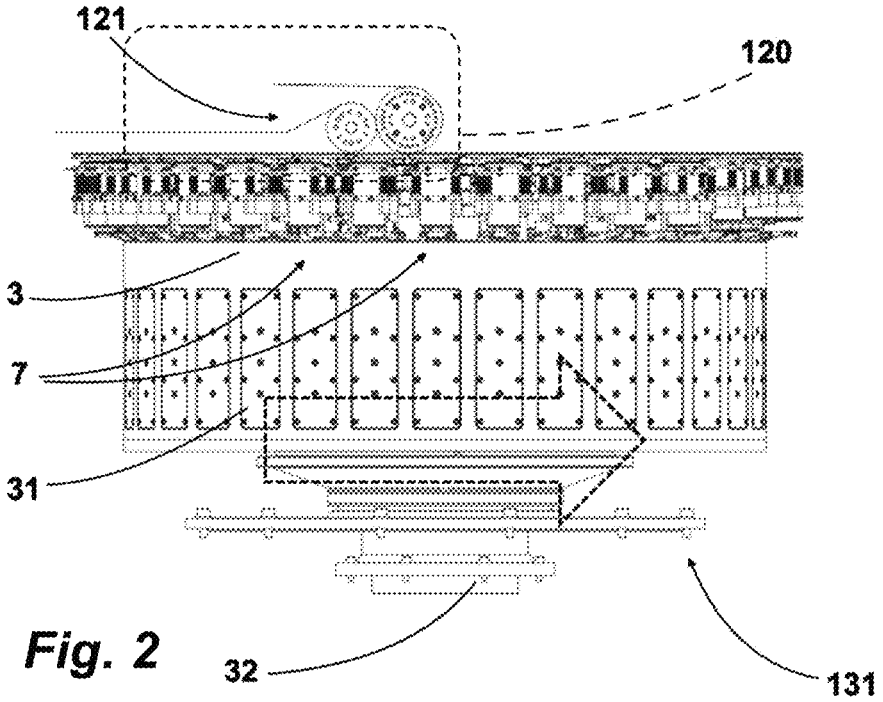
FIG. 2 shows a side elevation view of a transfer device made according to the present invention.

With reference to FIGS. 2 onwards, the production device for infusion type capsules described herein and referred to as a whole as 200, which embodies the present invention, comprises said release device 121 and said transport device 131, which in this example has a carousel structure.

Figure 3:
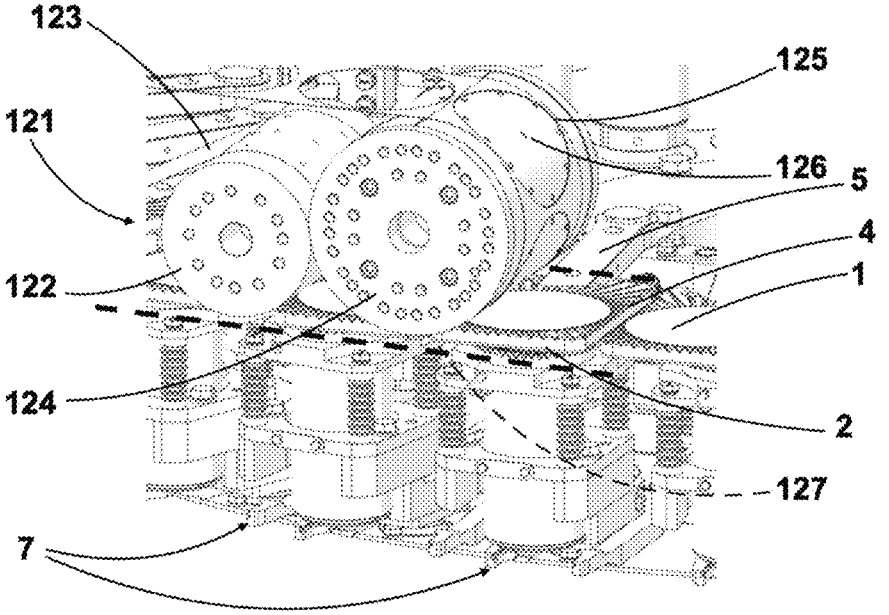
FIG. 3 shows a side perspective view of a second detail of the transfer device in FIG. 2.

The release device 121 (FIGS. 2 and 3) comprises a first roller-like drum 122 which receives a continuous strip 123 from a feed reel, which is unrepresented and of a substantially conventional type.

A second roller-like drum 124 receives the strip 123 from the first roller-like drum 122: on it are formed cutting elements 125 shaped as discs which act on the strip 123.

In particular, the two roller-like drums 122, 124 are arranged side by side and rotate around parallel rotation axes; they roll, creating a contact zone through which the strip 123 is passed.

The first roller-like drum 122 acts as a contrast element for the cutting elements 125 which, protruding from the cylindrical surface of the second roller 124 in said contact zone, score the strip 123 and thus create the discrete elements 1.

They remain attached to the second roller-like drum 124 which, for this purpose, incorporates a suction device with suction openings 126 arranged on its cylindrical surface.

The suction ceases in the zone of the second roller-like drum 124 facing downwards: along a feeding segment with a linear development 127, which is part of a release path defined by a flat strip 123 from which the discrete elements 1 are cut.

Therefore, the second roller-like drum 124 acts as a cylindrical feeder which is rotated, at said feeding segment 127, about an axis parallel to a plane on which the discrete elements 1 are released, and which has on its surface a device for retaining and then releasing discrete laminar elements, which is implemented by said suction device.

In the present example, considering that the roller-like drums rotate at a predetermined speed while performing the cutting operation described above, the discrete elements 1 are then continuously fed.

It is understood, however, that the discrete element release device 1 described above is only one of the possible alternatives for providing discrete elements 1 to be formed on a feeding segment 127.

In particular, the discrete elements could be pre-cut and supplied stacked, and extracted directly to the production device 200 with a feeder of any type that makes a substantially linear feeding segment 127.

It is also understood that the diameter of the second roller 124 may change, for example due to the need to cut flat discs of different sizes, but still as close as possible to each other on the strip from which they are cut.

Otherwise, it may be necessary to change the feed spacing from one discrete element 1 to the next.

Variation in the diameter of the second roller results in a different release spot of discrete element 1, and also a different release speed.

The transport device 131 is of the carousel type having a rotary drum 3 on which are mounted a plurality of movable shaping members 7, each arranged to form an infusion type capsule. They each comprise a respective receiving element 2.

To achieve a flow of cup-shaped elements and filters of adequate capacity, the number of delivery and support devices, i.e. moving members shall be at least 16, arranged equally spaced on the respective transport paths on the periphery of drum 3. In the present embodiment, there are said moving members 32.

The receiving elements 2 are therefore mobile, moving on a first transport path at a predetermined speed and in a continuous manner.

In particular, the rotary drum 3 comprising a wheel body 31 that is rotated about a vertical axis, defined by a hub 30 supported by a base 32, and then the receiving elements 2 move in a revolution in a substantially horizontal plane on which lies said transport path.

With the rotary drum configuration described here, its rotational speed may vary to ensure a flow of filters and cup-shaped elements with a capacity of at least 600 pieces per minute, even more preferably of at least 1000 pieces per minute or more, for example 1500 pieces per minute.

Each receiving element 2 comprises a horizontal flat surface, on which said discrete elements 1 are released, which has a surface knurling 4 to increase friction between discrete element 1 and receiving surface to promote the formation of a pleat in the lateral wall of the filter which will be formed as described below.

At the centre of the receiving element 2, a through-hole 11, of circular shape, is formed, on which the discrete element 1 is laid and, in particular, the centre of the hole 11 and the centre of the discrete element 1 must be perfectly superimposed.

To retain the discrete element 1 in a fixed reference position, the receiving element 2 may comprise a vacuum forming suction system between the receiving surface and the discrete element.

In this embodiment, the first transport path of the receiving elements 2 develops along a closed line, wherein said receiving elements 2 circulate on the transport path, and in particular the transport path is substantially circular because it is formed on the periphery of said rotary drum 3.

In the light of the foregoing, said one discrete element release path 1, and in particular said feeding segment 127, intersects said first receiving element transport path 2 at a receiving segment thereof, located in proximity to the release device 121.

The feeding segment 127 comprises the different release points of the discrete elements 1 which could be determined by second rollers 124 of different diameter, or by discrete elements 1 of different format and/or with a different feed spacing.

Thus, the transport device 131 comprises a mechanism for phasing the position of the receiving elements 2 which acts on them by moving them with respect to the transport path determined by the mere rotation of the rotary drum 30, the rotation speed of which is not varied in the case of discrete elements 1 of different format and/or with a different feed spacing.

For this purpose, the synchronizing mechanism moves the receiving elements 2 so that their position and/or their release speed of the discrete element 1, in said receiving segment, corresponds exactly to the release spot(s) of the discrete elements 1 and to their release speed, which corresponds to the peripheral speed of said second roller 124.

Figure 4:
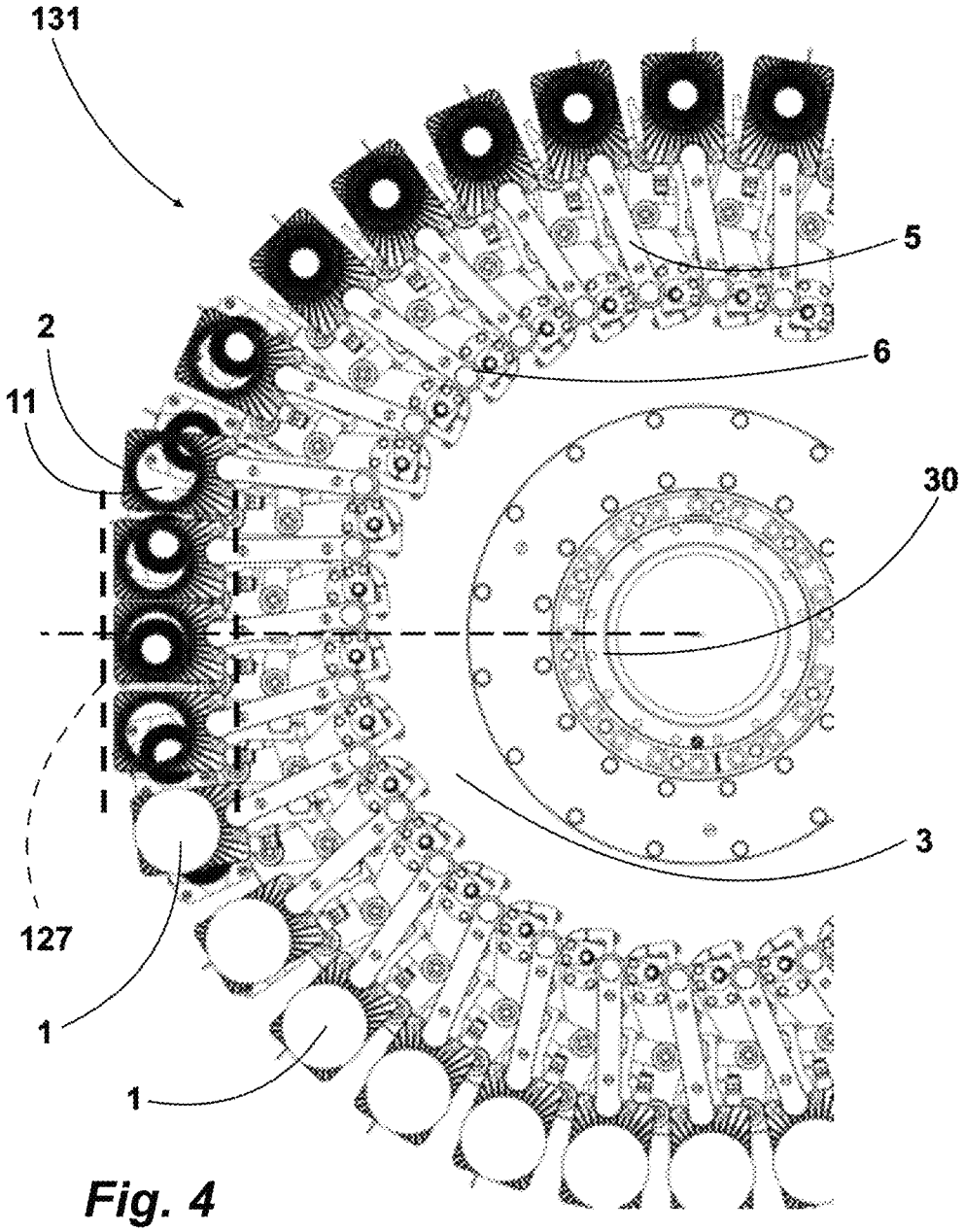
FIG. 4 shows an enlarged cross-sectional view of the production device from FIG. 2.

In the present embodiment, describing a possible preferred but not limiting solution, the synchronizing mechanism aligns the receiving elements 2 with each other at said receiving segment (FIG. 4) which can be subdivided into portions in which the receiving elements 2 have different translation speeds, constant in said portions, to correctly receive the discrete element 1 from the second roller 124.

These different speeds are determined by the distance between the receiving element 2 and the centre of rotation of the rotary drum 3, and by the relative speed of the receiving elements 2 with respect to the rotary drum, which are continuously varied by the synchronizing mechanism.

In this way, feeding segment 127 overlaps with the first transport path at said receiving segment, overlapping it along its entire length.

Thus, the receiving elements 2 are movable and the synchronizing mechanism comprises, for each receiving element 2, a rotatable articulation which is driven by the transport device 131 because it is integral with the rotary drum 3.

Said articulation comprises a system of levers articulated with each other, capable of moving the receiving element with three degrees of freedom, i.e., capable of raising and lowering it with respect to the rotary drum, of rotating it on itself around an axis perpendicular to it, and of roto-translating it thanks to a main lever 5 movable around a fulcrum 6 which is connected to a mechanism of rotation of the lever 5 around its fulcrum 6.

This rotation mechanism can be realised in many ways, for example by an electric motor adjusting the position of the lever 5 by making a so-called electronic cam.

Otherwise, it is possible to realise such a mechanism with only mechanical parts. For example, the rotational mechanism comprises a cam follower which is connected to said lever 5 at its fulcrum 6.

The aforesaid cam follower is therefore dragged by the rotary drum but interacts with a cam, integral with the base 31, moving on it.

The shape of the cam is such as to determine a rotation of the lever 5 such that a correspondence is determined between the receiving elements 2, in said receiving segment, and said release segment 127 of the release device 121.

Other cams may preside over the movement of the remaining two degrees of freedom.

The correspondence between receiving element 2 and the release spot of discrete element 1 ensures that the transfer of discrete elements 1 is successful whatever the release spot in the feeding segment 127.

The above-mentioned mobile moulding moving members 7 each comprise a filter delivery device 28 which, in general, provides filters to the target cup-shaped element.

In this embodiment, the filter delivery device 28 comprises said receiving element 2 and a respective shaping device 8 which provides for the shaping of the filter from said discrete elements 1.

In addition, each movable shaping member 7 includes a support device 9 for cup-shaped elements 10.

The shaping devices 8 move continuously on the rotary drum 3 following a first closed path, while the support devices 9, associated with said shaping devices 8, are moved continuously following a second closed path.

Thus, the shaping devices 8 realise a first transport system, in particular for the discrete elements 1 and for the filters 20 that will be formed therefrom, while the support devices realise a second transport system for the cup-shaped containers 10.

In this example, the first and second closed paths are both circular and are superimposed on each other over the entire periphery of drum 3.

It is understood that they could still be realised differently, and they could only be partially overlapped.

The support device 9 is shaped like a clamp, with a pair of pivoting claws 17 abutting a respective cup-shaped container 10 laterally, with curved profile ends adhering to the truncated conical surface of the container 10.

The latter, near its upper rib, may comprise a protruding shoulder that rests on the profile of the claws 17.

In this way, the cup-shaped container 10 is retained upright, with its upper opening facing upwards.

As mentioned above, the delivery device comprises the receiving element 2 which is an integral part thereof, and the aforementioned through-hole 11 constitutes the upper access mouth of a passing-through cavity 12 of the shaping device 8.

The passing-through cavity 12 has a cylindrical tubular structure, arranged vertically which has an entrance end 21 which is substantially funnel-shaped, and couples with the hole 11 of the receiving element, connecting with it to form a single sliding surface for the discrete element 1, when it is arranged on axis with the tubular structure, and an outlet end 22.

This arrangement is achieved by the positioning determined by the synchronizing mechanism which, in the path following the receiving segment, is operated to return the receiving elements 2 to the circular path which the passing-through cavities 12 follow as they are constrained to the drum 3.

The passing-through cavity 12 has a circular wall connected to said end of inlet 21 by a curved connector; it has an internal knurling formed by first vertical ribs extending vertically on said entrance end 21.

In use, the knurling formed by the first ribs can preferably be designed to create, when the filter runs along the ribs, a pleat on the side surface of the filters.

Each shaping device 8 comprises a punch 13 constituting the distal end, or head, of a piston which further comprises a vertically arranged stem 14.

Preferably, the punch 13 also has second ribs which cooperate in use with the first ribs of the passing-through cavity 12 to perform pleating on the side surface of the filter.

In particular, the pleating occurs when the filter slides in slots between the first and second ribs when they cooperate: the interference between the ribs and the possible friction, with its associated heat, cause a stretching effect of the filter material constituting discrete element 1, which causes permanent deformation.

Preferably, to increase or to obtain the aforesaid stretching effect, the passing-through cavity 12, in particular its walls, and/or the punch 13 may be equipped with a heating device (of the known and not illustrated type), for example with one or more electrically powered thermoresistors when the shaping step is in progress, to determine the aforesaid stretching effect on the pleats generating the pleating, or in general a wrinkling on the lateral wall of the filter.

The stem 14 extends to a respective proximal end at which it is articulated to a respective actuating arm 15; the actuating arms 15 of the device 200 are therefore radially arranged, the projection of the proximal ends of the stems shaping a circle corresponding to the periphery of the rotary drum 3 and the actuating arms 15 branching off from the stems 14 in a radial direction with respect to the drum 3, i.e. in the direction of the vertical projection of the hub 30, which is connected to a drive shaft.

Near the centre of the drum 3, the drive arms are connected to a respective drive rod 16, which can be raised and lowered in response to a drive equipment.

For example, such a drive equipment may consist of an additional cam integral with the fixed frame of the drum 3, which determines the raising and lowering of the rods 16 and, consequently, of the punches 13.

Therefore, the drive of all the mobile moulding equipment 7 is determined, by means of special kinematic chains, by the same drive shaft that causes the rotation of the rotary drum 3, so that this drive is automatically synchronised with the rotation of the carousel itself.

Figure 5:
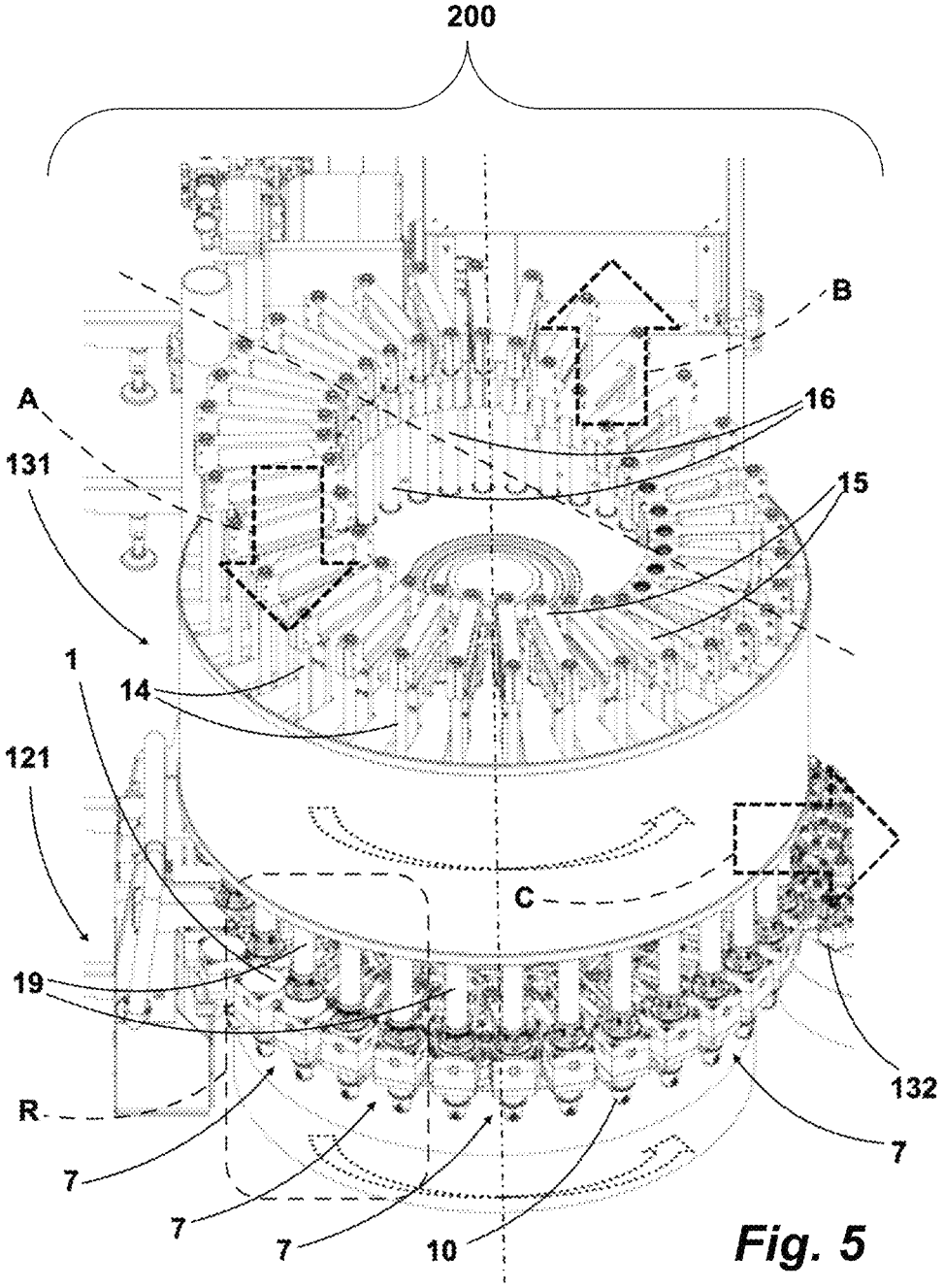
FIG. 5 shows a perspective view of the production device for infusion type capsules made according to the present invention.

Consequently, the transport device 131 can be roughly divided into two zones: a release zone A, shown in FIG. 5, in which the punches 13 are lowered, and an extraction zone B, also shown in FIG. 5, in which the punches 13 are raised; the two zones A and B are separated by a dotted line diagonal to the Figure.

In the release zone A there is therefore a shaping segment in which the movable shaping members 7 lower their respective punches 13.

Figure 6:
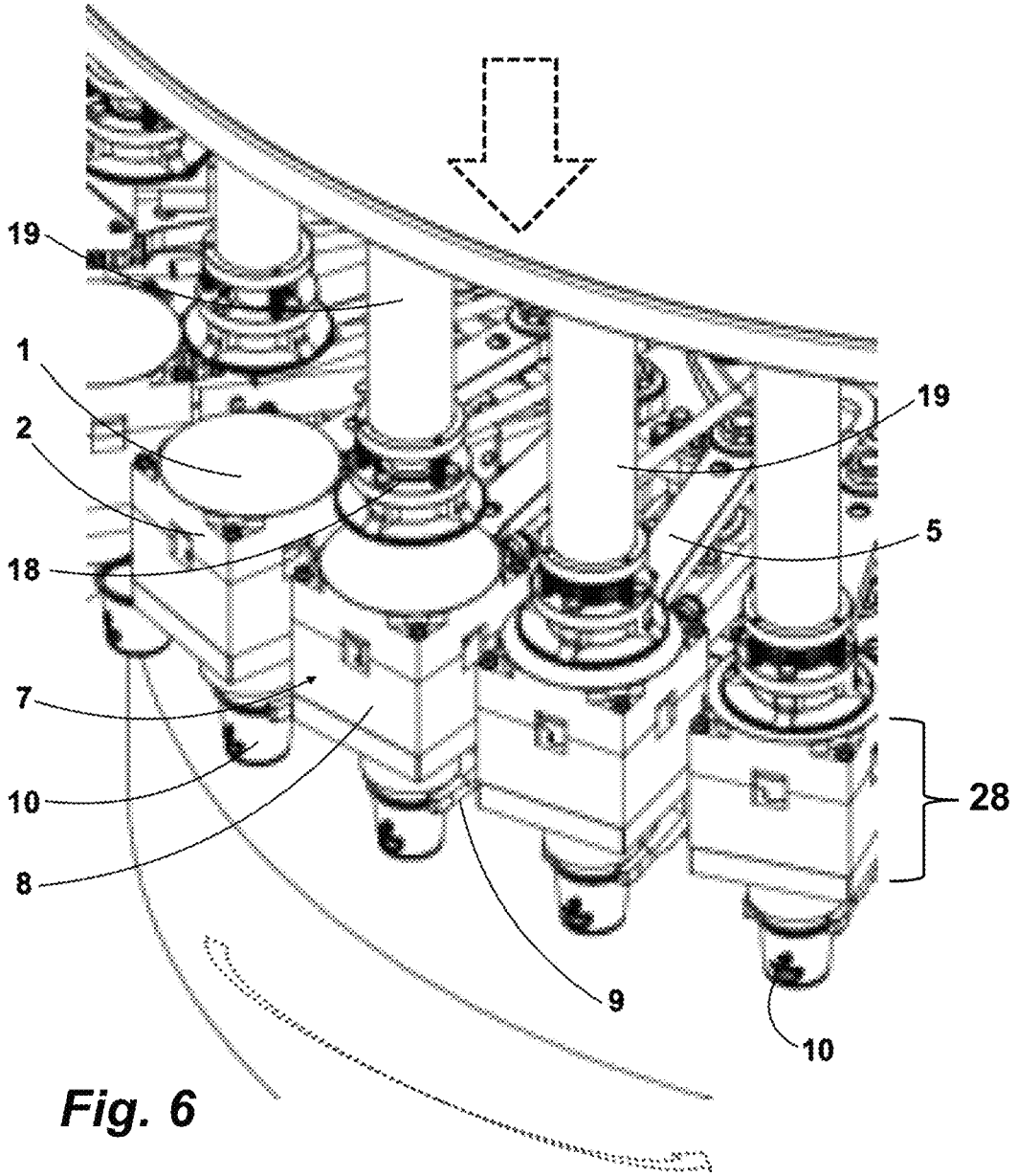
FIG. 6 shows an enlarged partial perspective view of a second detail of the production device in FIG. 5, visible in an R box.

Said feeding segment 127 also corresponds to the release zone, and above it the punches 13 of the shaping devices 7 are raised at a predetermined distance from the upper mouth 11 of the passing-through cavity 12, i.e. from the hole 11 of the receiving element on which the discrete element 1 is laid (FIG. 6).

The shaping device 8 a press element 18 which is associated with the stem 14 and therefore it is movable in synchrony with the respective punch 13, lowering with it.

The press element is positioned at a certain distance from the punch 13 and is however controlled in elevation and lowering independently of the stem 14, thanks to a cylinder element 19 concentric to the stem 14 and arranged outside it, which is also controlled in a similar manner to the stem 14 and the punch 13.

The press element 18 comprises a circular plate which is positioned to cooperate in contact with the support surface of the receiving element 2, resting on its hole 11 and on the discrete element 1 laid thereon.

In this way, before the punch 13 begins its shaping stroke inside the passing-through cavity 12. The press element 18 blocks and crushes said discrete element 1: the knurls on the surfaces of the receiving element 2 and the press element 18 cooperate to this end, and promote the formation of a pleat whose formation will be described in greater detail below.

However, before the punch 13 can tear the material of the discrete element 1, the press element lifts slightly, releasing the discrete element 1 which can thus be formed and dragged in the passing-through cavity 12 to the cup-shaped element 10.

Figure 7E:
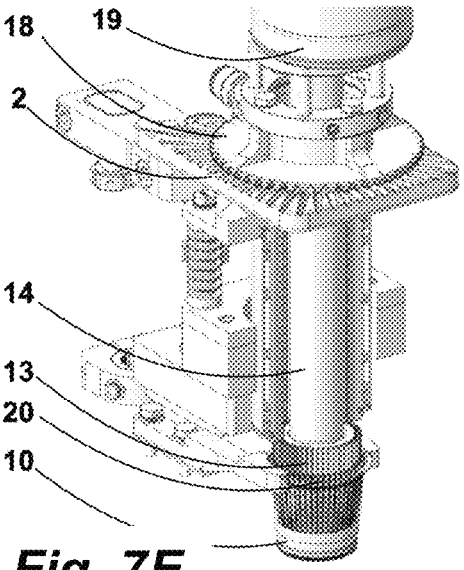

Following the receiving segment, the first closed path comprises a shaping segment, in which the punches 13 are penetrated through the respective upper mouth 11 of the receiving element 2 which, in that section, must be exactly on axis with the passing-through cavity 12 (FIGS. 7A and 7B).

This penetration of the punch 13 mouth, so as to push the discrete element into the passing-through cavity, the shape of the walls inside the passing-through cavity and of the surface of the punch, and their mutual interference, determine in turn a cup shape of the filter 20 (FIGS. 7C and 7D).

The punch 13 has respective second vertical ribs complementary to said first vertical ribs, which are inserted into the slots between the first ribs so as to cooperate with them to give the filter 20 a cup shape, with curved wrinkled, i.e. pleated, lateral walls.

When the punch 13 has arrived at the distal end of the passing-through cavity 12, the formation of the filter 20 is complete; however, it continues to its lower dead centre and, in so doing, pushes the filter 20 further into the insertion segment of the first closed path. This further advancement thus causes the insertion of the filter 20 into the cup-shaped container 10, thus shaping the capsule before the fixing of the filter 20, which will take place at a later stage.

Figure 7F:
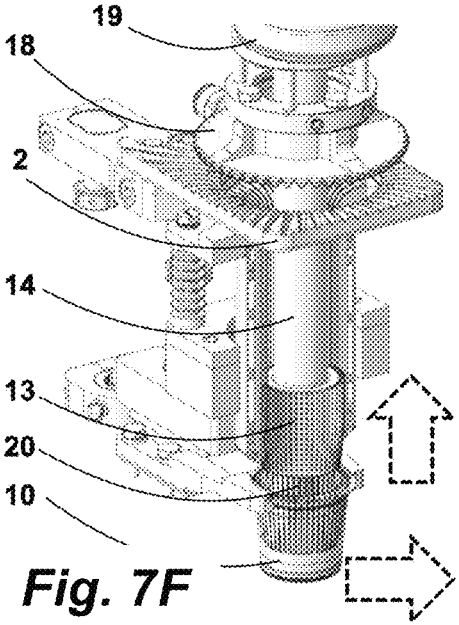
Figure 7G:
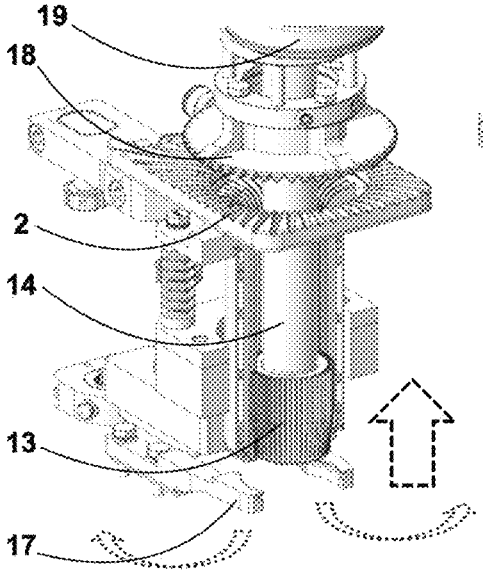

In the present example, the advancement of the punch 13 continues until the filter 20 exits completely (FIG. 7E) from the passing-through cavity 12, no longer being retained by it and thus falling into the cup-shaped container 10 (FIGS. 7F and 7G).

Once the insertion segment has been completed, the now-formed capsule reaches an extraction section: in this the support device 9 releases the capsule and, in this regard, the claws 17 of the pincers of the support device 9 open to allow the capsule to pass to the next wheel 132 (FIGS. 5 and 7F).

Figure 7H:
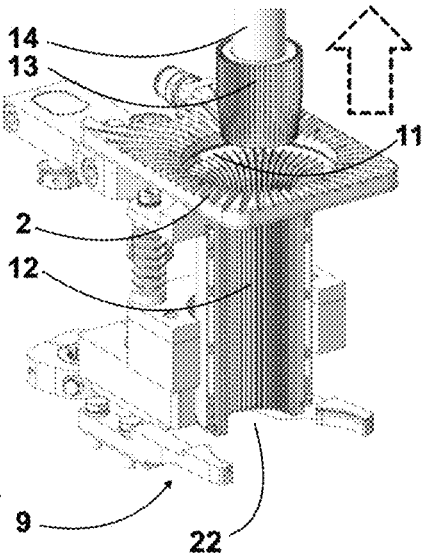
Figure 7J:
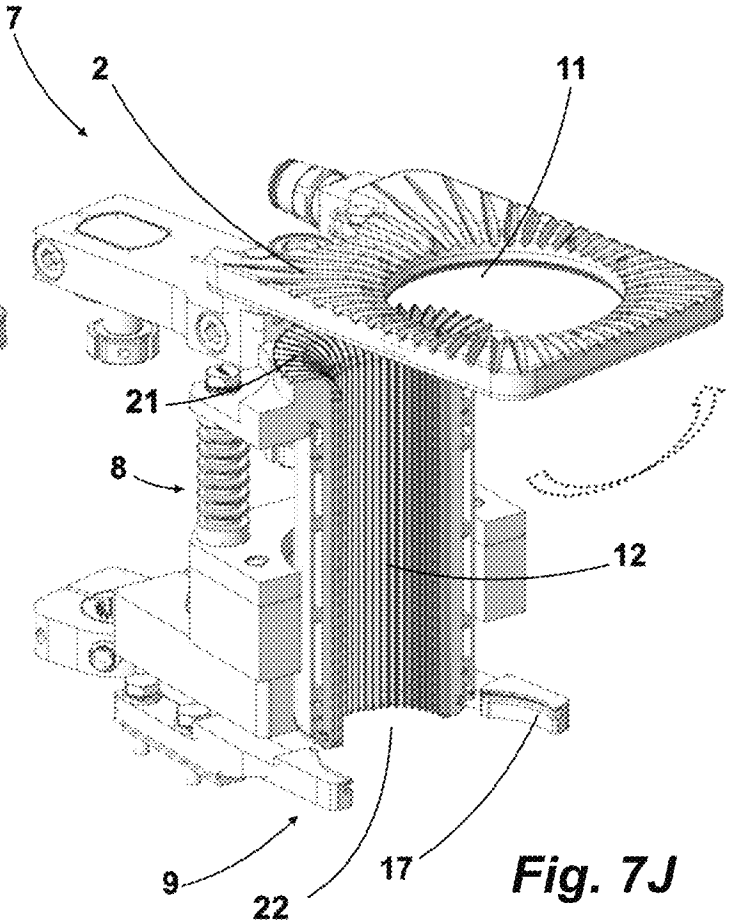
Figure 7I:
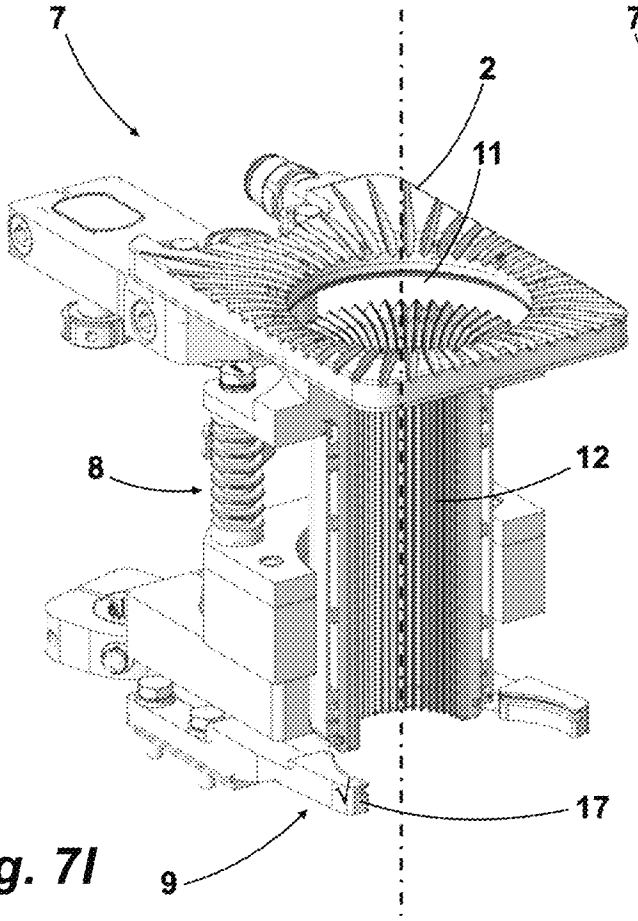

At the same time, the punch 13 is raised, it being understood that also at this stage the hole 11 of the receiving element 2 and the passing-through cavity 12 are on axis (FIG. 7H).

To the above-described production device for infusion type capsules, a person skilled in the art may, in order to meet additional and contingent requirements, make numerous further modifications and variations, all of which are, however, within the scope of protection of the present invention as defined by the appended claims.

The invention claimed is:

1. A capsule production device to deliver filters inside respective cup-shaped containers, comprising:

filter delivery devices;

a first transport system of said filter delivery devices, configured to continuously move the filter delivery devices along a first closed path; and a second transport system of support devices, said support devices being continuously moveable along a second closed path, each support device configured to receive a respective cup-shaped container, wherein said first closed path comprises a filter inserting segment superimposed to said second closed path in order to synchronize the filter delivery devices and respective support devices to each other and continuously achieve a transfer of the filters to target cup-shaped containers, and wherein:

said first and second transport systems are mounted on a same circular carousel, said first and second transport systems have a circular shape, said first and second transport systems are entirely superimposed to each other, and each delivery device and a respective support device are associated to each other within a same movable member configured to be moved by said circular carousel.

2. The capsule production device according to claim 1, further comprising a transport device having a rotary drum defining said first and second closed paths, said first and second transport systems being formed on said rotary drum.

3. The capsule production device according to claim 1, wherein each delivery device comprises a shaping device for shaping the filters from discrete elements fed in the first closed path at a receiving segment of the first closed path, and the first closed path comprises a shaping segment for shaping the filters between the receiving segment and the filter inserting segment.

4. The capsule production device according to claim 3, wherein each shaping device comprises a passing-through cavity with internal walls, the passing-through cavity having i) an upper mouth through which a discrete element is configured to be released and ii) a punch with a punch surface, the punch being actionable to penetrate through said upper mouth to push the discrete element into the passing-through cavity, the internal walls of the passing-through cavity and the punch surface are shaped to mutually interfere with each other to produce a cup-shaped form of the filter, the punch is configured to be lifted to a predetermined distance from the upper mouth at least at said receiving segment, and the shaping devices are configured to be operated at said shaping segment, by lowering respective punches of said shaping devices.

5. The capsule production device according to claim 4, wherein insertion of the filter into a respective cup-shaped container occurs through a piston associated with said punch and configured to push the filter into said passing-through cavity so that the filter falls into the respective cup-shaped container.

6. The capsule production device according to claim 5, i) wherein:

said first and second transport systems are mounted on a same circular carousel, said first and second transport systems have a circular shape, said first and second transport systems are entirely superimposed to each other, and each delivery device and a respective support device are associated to each other within a same movable member configured to be moved by said circular carousel., ii) further comprising a transport device having a rotary drum defining said first and second closed paths, said first and second transport systems being formed on said rotary drum, and iii) wherein actuation of all shaping devices occurs through a same drive shaft causing rotation of the rotary drum, thus automatically synchronizing the actuation with the rotation of the circular carousel.

7. The capsule production device according to claim 6, wherein each movable member comprises i) a respective shaping device and ii) a respective support device, both positioned in a column.

8. The capsule production device according to claim 7, wherein the transport device comprises a synchronizing mechanism acting on said receiving members by moving said receiving members with respect to the transport device, so that a position of the receiving members in said receiving segment corresponds to a position of the discrete elements in a respective feeding section.

9. The capsule production device according to claim 8, wherein the synchronizing mechanism comprises, for each receiving member, a rotatable articulation actuated by the transport device.

10. The capsule production device according to claim 4, wherein each movable member comprises a respective receiving member movable with respect to said passing-through cavity on which said upper mouth is formed, and in said first closed path, each receiving member receives a respective discrete element in said receiving segment.

11. The capsule production device according to claim 10, wherein the receiving members are aligned to each other at said receiving segment.

12. The capsule production device according to claim 10, wherein each receiving member is plate-shaped, with the upper mouth formed at the centre thereof, including a horizontal planar surface on which said discrete elements are released.

13. The capsule production device according to claim 12, wherein said receiving member receives a movable press member synchronized with a respective punch, the movable press member being configured to lock and squeeze said discrete element before insertion of the punch.

14. The capsule production device according to claim 4, wherein said passing-through cavity has a cylindrical tubular structure having a funnel-shaped entrance end and an outlet end.

15. The capsule production device according to claim 14, wherein said passing-through cavity has a circular wall, filleted with said entrance end, internally having first vertical ribs extending at said entrance end, the punch comprising respective second vertical ribs cooperating with said first vertical ribs inserting in the groove therebetween.

16. A production process for infusion type capsules, to deliver filters inside respective cup-shaped containers, comprising:

moving a plurality of delivery devices along a first closed path having a circular shape, moving a corresponding plurality of support devices, each retaining a respective cup-shaped container, along a second closed path having a circular shape, the second closed path being superimposed with the first closed path at an insertion segment, and inserting the filters in respective cup-shaped containers at the insertion segment. wherein, at least at said insertion segment, movement of the delivery devices and movement of the support devices are synchronized by associating each delivery device to a respective support device within a same movable member.

17. The production process according to claim 16, wherein the plurality of delivery devices comprises respective shaping devices for shaping filters from discrete elements, the production process comprising:

releasing a discrete element on a receiving member having a mouth on which the discrete element is positioned, said mouth cooperating with a respective shaping device; and performing a shaping, wherein a filter is formed by deforming said discrete element in said shaping device.

18. The production process according to claim 17, wherein the shaping device comprises a passing-through cavity and a punch, during said shaping, the mouth of the receiving member is placed so that the punch is penetrated through the mouth of the receiving member and said passing-through cavity, and the shape of the walls inside the passing-through cavity, the surface of the punch, and the mutual interference therebetween produce a cup-shaped filter obtained from said discrete element.

19. The production process according to claim 18, wherein, during said inserting step, the punch keeps running through the passing-through cavity, causing i) discharge of the filter from an outlet end of the filter and ii) insertion of the filter in a respective cup-shaped container.

20. A packaging apparatus comprising the capsule production device according to claim 1.

* * * * *